US006144825A

United States Patent [19]

Park

[11] Patent Number: 6,144,825

[45] Date of Patent: Nov. 7, 2000

[54] IMAGE FORMING APPARATUS USING AN ELASTIC PHOTOSENSITIVE DRUM FOR AN ELECTROPHOTOGRAPHIC PROCESSOR FOR ENHANCING CHARGE AND TRANSFER CHARACTERISTICS

[75] Inventor: Ki-Ju Park, Yongin-shi, Rep. of Korea

[73] Assignee: SamSung Electronics Co., Ltd., Kyungki-do, Rep. of Korea

[21] Appl. No.: 09/055,920

[22] Filed: Apr. 7, 1998

[30] Foreign Application Priority Data

Apr. 7, 1997 [KR] Rep. of Korea ..... 97/12640

[51] Int. Cl.[7] ..... G03G 15/22

[52] U.S. Cl. ..... 399/159; 430/56; 430/59.4; 430/69

[58] Field of Search ..... 430/56, 59.4, 69; 399/159

[56] References Cited

U.S. PATENT DOCUMENTS

| | | | |
|---|---|---|---|
| 4,105,445 | 8/1978 | Wilson et al. | 430/56 |
| 4,601,963 | 7/1986 | Takahashi et al. | 430/56 |
| 4,876,572 | 10/1989 | Nagatsuna | 399/111 |
| 4,896,191 | 1/1990 | Ohyabu et al. | 399/111 |
| 5,119,137 | 6/1992 | Katagata | 399/116 |
| 5,132,200 | 7/1992 | Fukuda et al. | 430/131 |
| 5,218,405 | 6/1993 | Wong | 399/117 |
| 5,255,053 | 10/1993 | Green et al. | 399/118 |
| 5,270,141 | 12/1993 | Ohtani et al. | 430/62 |
| 5,485,250 | 1/1996 | Kashimura et al. | 430/66 |
| 5,504,558 | 4/1996 | Ikezue | 430/56 |
| 5,512,976 | 4/1996 | Kamano | 399/116 |
| 5,536,609 | 7/1996 | Jackson et al. | 430/45 |
| 5,570,160 | 10/1996 | Miwa et al. | 399/116 |
| 5,640,650 | 6/1997 | Watanabe et al. | 399/117 |
| 5,715,505 | 2/1998 | Tombs et al. | 399/299 |
| 5,722,016 | 2/1998 | Godlove et al. | 430/69 |

*Primary Examiner*—Roland Martin
*Attorney, Agent, or Firm*—Robert E. Bushnell, Esq.

[57] ABSTRACT

An image forming apparatus using an electrophotographic processor with a transfer roller, a charge roller and a photosensitive drum for image formation. The photosensitive drum is comprised of a cylindrical elastic body exhibiting a predetermined level of elasticity; a conductive film formed on an outer surface of said cylindrical elastic body; an image carrier generation layer of a first photoconductive material formed on the conductive film; and an image carrier transfer layer of a second photoconductive material formed on said image carrier generation layer.

10 Claims, 3 Drawing Sheets

IMAGE FORMING APPARATUS USING AN ELASTIC PHOTOSENSITIVE DRUM FOR AN ELECTROPHOTOGRAPHIC PROCESSOR FOR ENHANCING CHARGE AND TRANSFER CHARACTERISTICS

CLAIM FOR PRIORITY

This application makes reference to, incorporates the same herein, and claims all benefits accruing under 35 U.S.C. §119 from an application for IMAGE FORMING APPARATUS FOR ELECTROPHOTOGRAPHIC PROCESSOR earlier filed in the Korean Industrial Property Office on the $7^{th}$ of April 1997, and there duly assigned Ser. No. 12640/1997, a copy of which application is annexed hereto.

BACKGROUND OF THE INVENTION

1. Technical Field

The present invention generally relates to an image forming apparatus using an electrophotographic processor, such as a laser beam printer, a facsimile machine, and a photocopier, and more particularly, relates to an image forming apparatus using an elastic photosensitive drum for an electrophotographic processor with a nip created between the photosensitive drum and a charge roller and a transfer roller for enhancing the charging and transfer characteristics.

2. Related Art

Electrophotographic developing processes are widely used in image forming apparatuses to produce images on recording media in response to video signals. Common examples of an electrophotographic printing apparatus are a laser beam printer, a copier, and a facsimile system which forms images on an individual sheet of paper through a series of electrostatic image-forming steps as disclosed, for example, in U.S. Pat. No. 4,876,572 for *Image Recording Having A Removable Image Forming Case* issued to Nagatsuna, U.S. Pat. No. 4,896,191 for *Sheet Transferring Mechanism In An Electrophotographic Recording Apparatus* issued to Ohyabu et al., U.S. Pat. No. 5,119,137 for *Structure And Method Of Mounting Recording Units In Electrophotographic Recording Apparatus* issued to Katagata, U.S. Pat. No. 5,255,053 for *Image Forming Apparatus Having A Transfer Drum, An Image Member Cartridge And Exposure Means* issued to Green et al., U.S. Pat. No. 5,512,976 for *Image Forming Apparatus Having Rotation Resistance Adjusting Means For Adjusting Rotation Resistance On A Photosensitive Drum* issued to Kamano, U.S. Pat. No. 5,570,160 for *Image Forming Apparatus Having A Rotatable Photoreceptor* issued to Miwa et al., U.S. Pat. No. 5,640,650 for *Process Cartridge Including A Spaced Rolling Members Support Feature And Image Forming Apparatus Using The Same* issued to Watanabe et al.

Generally, the process of electrostatic image forming includes charging a photosensitive drum to a substantially uniform potential so as to sensitize the surface thereof. The charged portion of the photosensitive drum is exposed to a light image to record an electrostatic latent image on its surface. The latent image is then developed by applying toner from a developing unit onto the photosensitive drum which is subsequently transferred and fixed on a recording paper which is fed from a paper feeding unit. When a toner image is fixed on a recording paper, the toner image is first heated and fused onto the recording paper, and then naturally cooled so that it is fixed onto the recording paper.

One significant problem that frequently occurs in such an image forming apparatus is the excessive and uneven pressure often asserted by the charge roller and the transfer roller onto the photosensitive drum during an image formation which causes damage to the outer surface of the photosensitive drum and disrupts toner image on the photosensitive drum to reduce the print quality. Examples of conventional photosensitive drum designs with high durability for high quality images are disclosed in U.S. Pat. No. 5,132,200 for *Electrophotographic Photoreceptor With Porous Anodized Al Layer And Process for Producing The Same* issued to Fukuda, U.S. Pat. No. 5,218,405 for *Photoreceptor Drum Runout Control Apparatus* issued to Wong, U.S. Pat. No. 5,270,141 for *Image Holding Member, And Electrophotographic Apparatus, Apparatus Unit, And Facsimile Machine Employing The Same* issued to Ohtani et al., U.S. Pat. No. 5,504,558 for *Electrophotographic Photosensitive Member, And Electrophotographic Apparatus And Device Unit Employing The Same* issued to Ikezue, U.S. Pat. No. 5,485,250 for *Electrophotographic Apparatus With Photosensitive Member Having Surface Layer Of Binder Resin And Fluoro And/Or Silicon Compound Particles* issued to Kashimura et al. While the conventional photosensitive drum designs are effective in their own rights, I have noted that further improvement can still be contemplated.

SUMMARY OF THE INVENTION

Accordingly, it is therefore an object of the present invention to provide an improved an image forming apparatus using an electrophotographic process for forming images on print media.

It is also an object to provide an electrophotographic processor using an elastic photosensitive drum which has a nip maximally created between the photosensitive drum and a charge roller and a transfer roller for enhancing the charge and transfer characteristics.

It is another objective to provide an elastic photosensitive drum for an electrophotographic processor which has a constant gap from a developing roller regardless of the amount of toner for minimizing load by friction.

It is still another objective to provide an image forming apparatus for an electrophotographic processor which can significantly reduce a pressure applied to respective charge and transfer rollers.

These and other objects of the present invention can be achieved by an image forming apparatus which comprises a photosensitive drum, a developing roller for developing an electrostatic latent image formed on the photosensitive drum during an image forming operation; an agitator for agitating and mixing toner as supplied from a toner supply chamber with a carrier for developing said electrostatic latent image on the photosensitive drum; a supply roller for supplying toner from the toner supply chamber to the developing roller for developing the electrostatic latent image; an agitation member disposed in the toner supply chamber for rotating and agitating toner contained the toner supply chamber to feed said toner to the supply roller; a charge roller disposed to charge the photosensitive drum for the image forming operation, when pushed in contact with the photosensitive drum; and a transfer roller disposed to transfer the electrostatic latent image from said photosensitive drum onto an individual sheet of print media, when pushed in contact with the photosensitive drum. The photosensitive drum is made of a cylindrical elastic body exhibiting a predetermined level of elasticity, a conductive film formed on an outer surface of the cylindrical elastic body, an image carrier generation layer of a first photoconductive material formed on the conductive film, and an image carrier transfer layer of a second photoconductive material formed on the image carrier generation layer so that nips between the charge roller and the transfer roller relative to the photosensitive drum can be created and kept constantly in order to improve the charge and transfer characteristics of a toner image on a print medium.

The present invention is more specifically described in the following paragraphs by reference to the drawings attached only by way of example.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
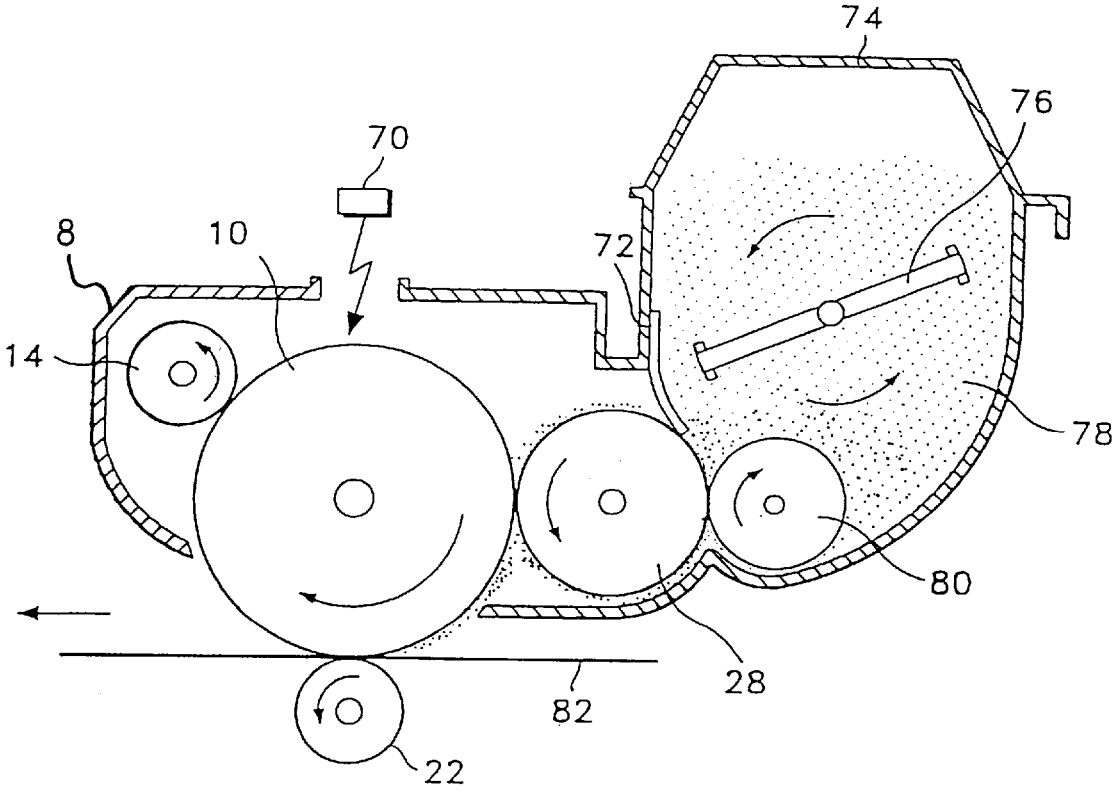
FIG. 1 illustrates a typical electrophotographic processor of an image forming apparatus.

Referring now to the drawings, FIG. 1 illustrates a typical electrophotographic processor of an image forming apparatus such as a laser beam printer, a copier and a facsimile system. As shown in FIG. 1, the electrophotographic processor generally includes a frame 8, a photosensitive drum (i.e., photoconductive member) 10 for serving as a latent image carrier to form a latent image on an individual sheet of print media 82 as guided by a paper guide path, a charger device 14 for charging the photosensitive drum 10, a transfer device 22 for enabling toner to be transferred to the photosensitive drum 10 to develop the latent image, a developing roller 28 for developing a toner image on the photosensitive drum 10 upon exposure from a laser scanning unit 70, a toner cartridge 74 loaded on a loading portion of the frame 60 for supplying toner 78, an agitator 76 for dispersing the toner within the frame 60, a supply roller 80 for supplying toner to the developing roller 28 for toner image development. The amount of toner 78, adhering to the outer surface of developing roller 28, is regulated by a doctor blade 72.

When toner 78 is furnished via the toner cartridge 74, toner 78 is agitated by the agitator 76, and delivered to a supply roller 80 by the rotation of agitator 76, and then furnished to the developing roller 28 by the rotation of supply roller 80. The outer surface of the photosensitive drum 10 is uniformly charged to a negative polarity by the electrical action of charge roller 14, and a laser scanner unit 70 emits a laser beam to the charged areas of photosensitive drum 10 upon application of an electric signal. A latent image is formed on the charged areas of the photosensitive drum 10 exposed to the laser beam. The latent image, formed on photosensitive drum 10 or 50, is visualized as a toner image through developing roller 28.

A print medium 82 held in a cassette (not shown) is fed to a transfer roller 22 by a pickup roller, and the toner image on photosensitive drum 10 is transferred to the print medium 82 by the high compressive action of transfer roller 22. Print medium 82 passes between heating and compression rollers of a fixing unit (not shown) so that the toner image is fixed on print media 82 by heat and pressure.

Figure 2:
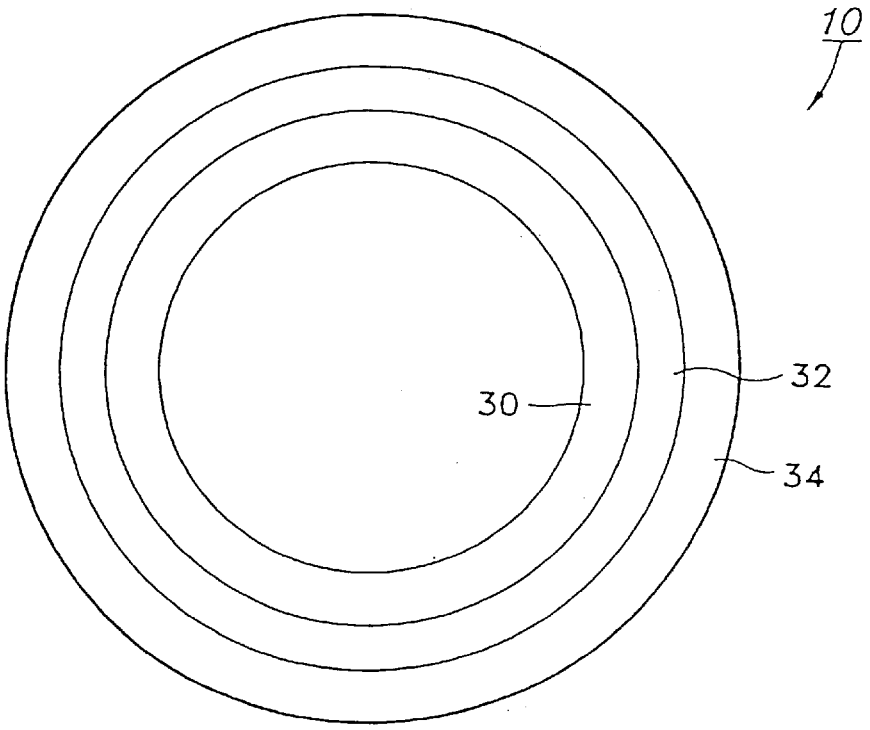
FIG. 2 is a sectional view of a photosensitive drum of the electrophotographic processor as shown in FIG. 1.

The photosensitive drum 10 which becomes a conductor upon application of light for forming a latent image on its outer surface, has a pipe 30 made of conductive aluminum, as shown in FIG. 2. A carrier generation layer 32, coated with a pigment of phthalocyanine, is formed on the outer surface of aluminum pipe 30 to receive a predetermined electric current. Carrier generation layer 32 is coated with $H_2Pc$, CuPc, VOPc, AlCPcCl, InClPcCl, or GaCIPc according to the material that forms the pipe 30. A carrier transfer layer 34 is formed on the carrier generation layer 32 to transfer the toner image to the transfer roller 22. Carrier transfer layer 34 is coated with a resin dispersed solution made by dissolving a high-molecular weight organic photoconductive substance such as PVCz and a low-molecular weight organic photoconductive substance by binder polymer.

Figure 3:
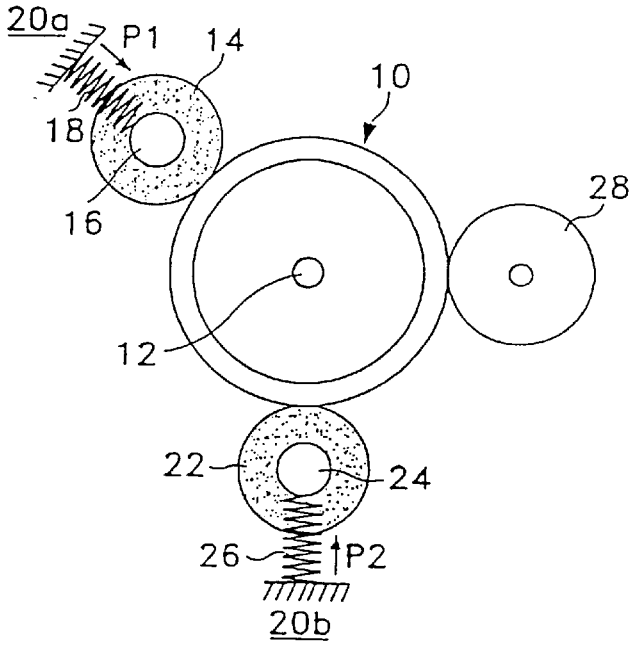
FIG. 3 is a side view of a photosensitive drum, a charge roller, a transfer roller, and a developing roller of the electrophotographic processor as shown in FIG. 1.

FIG. 3 is a side view of a photosensitive drum 10, a charge roller 14, a transfer roller 22, and a developing roller 28 of the electrophotographic processor of FIG. 1. As shown in FIG. 3, the charge roller 14, the transfer roller 22, and the developing roller 28 are installed around the photosensitive drum 10 either in contact with one another or spaced apart by a given distance. A shaft 12 is provided to the core of photosensitive drum 10 for receiving a driving force from a driving motor. Charge roller 14 is installed over the left side of photosensitive drum 10, and comes in close contact with photosensitive drum 10 by a pressure P1 created by a first spring 18 provided to a first frame 20*a*. Charge roller 14 contacts photosensitive drum 10 under a pressure of 1 kg or more. Developing roller 28 providing toner 78 is installed at the right side of photosensitive drum 10 and is spaced apart therefrom by a given distance. Transfer roller 22 is installed under the photosensitive drum 10. That is, transfer roller 22 comes in close contact with photosensitive drum 10 by a pressure P2 created by a second spring 26 provided to a second frame 20*b*. First and second springs 18 and 26 each apply excessive pressures P1 and P2 to charge roller 14 and transfer roller 22 to make a required nip as charge roller 14 and transfer roller 22 come in contact with photosensitive drum 10. Hence, excessive load is applied to the outer surface of photosensitive drum 10, causing damage to the photosensitive drum 10. Thus, uneven pressure is applied to photosensitive drum 10 so that a toner image is not correctly formed on photosensitive drum 10, which causes a deterioration in the print quality of an image. There must be a very small gap between developing roller 28 and photosensitive drum 10, and developing roller 28 cannot keep a gap from photosensitive drum 10 by pressures P1 and P2. In addition, developing roller 28 needs a great amount of torque.

Figure 4:
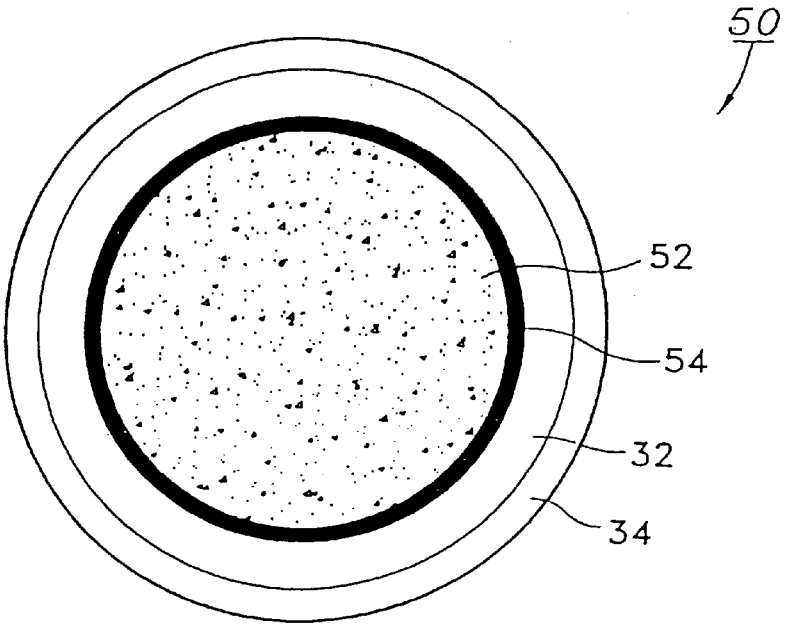
FIG. 4 is a sectional view of a photosensitive drum constructed according to the principles of the present invention.
Figure 5:
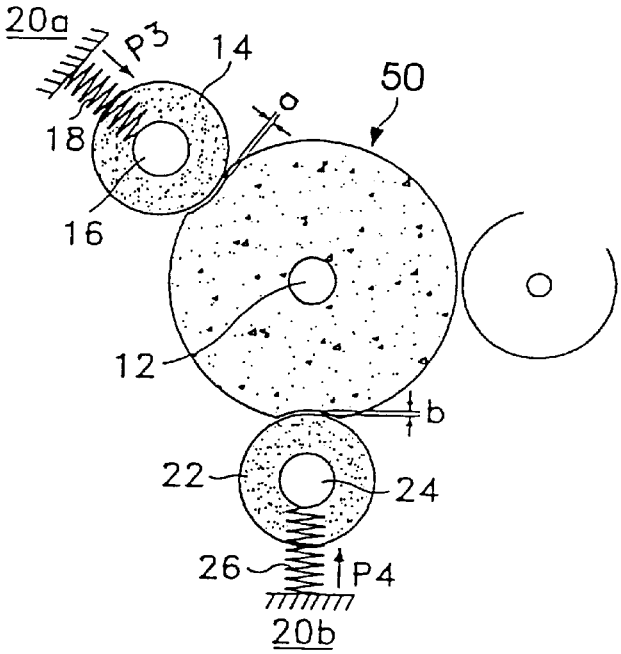
FIG. 5 is a side view of a photosensitive drum, a charge roller, a transfer roller, and a developing roller of an electrophotographic processor constructed according to the principles of the present invention.

Turning now to FIGS. 4 and 5, which illustrate a photosensitive drum (i.e., photoconductive member) of an electrophotographic processor, and its relation with a charge roller, a transfer roller, and a developing roller in the electrophotographic processor for forming images in accordance with the principles of the present invention. An elastic photosensitive drum 50 which improves the charge and transfer characteristics by enlarging a nip between the photosensitive drum 50 and the charge roller 14, and the photosensitive drum 50 and the transfer roller 22, has a conductive thin film 54 on its outer surface, as shown in FIG. 4. An elastic body 52 with a predetermined elasticity is provided to the interior of pipe-shaped film 54, and elastic body 52 may be made of a urethane of silicone sponge with a required elasticity so as to enlarge a nip as charge roller 14 and transfer roller 22 contact photosensitive drum 50, respectively. Elastic body 52 may be made of nitrile-butadiene rubber (NBR), a conductive rubber, with a resistance of $10^8$ Ω or less, and may be made of any material with a required elasticity.

A carrier generation layer 32, coated with a pigment of phthalocyanine to receive a predetermined electric current, is formed on the surface of film 54. Carrier generation layer 32 is coated with $H_2Pc$, CuPc, VOPc, AlCPcCl, InClPcCl, or GaCIPc according to the material forming the pipe 30. A carrier transfer layer 34 is formed on the carrier generation layer 32 to transfer the toner image to the transfer roller 22. Carrier transfer layer 34 is coated with resin dispersed solution made by dissolving a high-molecular weight organic photoconductive substance such as PVCz and a low-molecular weight organic photoconductive substance by binder polymer.

Referring to FIG. 5, the shaft 12 is provided to the core of photosensitive drum 50 for receiving a driving force from a driving motor. Charge roller 14 is installed over the right side of photosensitive drum 50, and a pressure P3 of about 200 kg to 300 kg is applied to charge roller 14 by a first spring 18 provided to a frame 20*a* so that charge roller 14 contacts the photosensitive drum 50 pushing its outer surface. That is, there creates a nip "a" between charge roller 14 and photosensitive drum 50 by an elastic force of elastic body 52. First spring 18 presses both ends of a shaft 16. A developing roller 28 providing toner 78 is installed at the right side of photosensitive drum 50 and is spaced apart therefrom by a given distance. Transfer roller 22 is installed under photosensitive drum 50, and receives a pressure P4 of about 300 kg from a second spring 26 provided to a frame 20*b*, thus pushing elastic photosensitive drum 50. A nip "b" is created between transfer roller 22 and photosensitive drum 50 by the elastic force of elastic body 52. Second spring 26 presses both ends of shaft 24 of transfer roller 22.

As a result, the since photosensitive drum 50 is made of an elastic material, first spring 18 and second spring 26 each push charge roller 14 and transfer roller 26 by pressures P3 and P4 of about 200 kg to 300 kg, and nips "a" and "b", each created between drum 50 and charge roller 14 and drum 50 and transfer roller 22, become enlarged and kept constantly.

As described above, since the photosensitive drum of an electrophotographic processor is made of an elastic sponge or rubber, each nip created between the photosensitive drum and the charge roller and the photosensitive drum and the transfer roller, is enlarged and constantly kept with the small amount of pressure given by the first and second springs, thus improving the charge and transfer characteristics. Since the pressure applied to each of the charge and transfer rollers is relatively low, the load acting on the developing roller is significantly reduced so that the torque, required for driving the developing roller, is decreased. In addition, the gap between the photosensitive drum and the developing roller is constantly maintained regardless of the amount of toner.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. An image forming apparatus, comprising:

a photosensitive drum made of a cylindrical elastic body exhibiting a predetermined level of elasticity, a conductive film formed on said cylindrical elastic body, an image carrier generation layer of a first photoconductive material formed on the conductive film, and an image carrier transfer layer of a second photoconductive material formed on said image carrier generation layer;

a developing roller for developing an electrostatic latent image formed on said photosensitive drum during an image forming operation;

means for agitating and mixing toner as supplied from a toner supply chamber with a carrier for developing said electrostatic latent image on said photosensitive drum;

a supply roller for supplying said toner from said toner supply chamber to said developing roller for developing said electrostatic latent image;

an agitation member disposed in said toner supply chamber for rotating and agitating said toner contained said toner supply chamber to feed said toner to said supply roller;

a charge roller disposed to charge said photosensitive drum for said image forming operation, when pushed in contact with said photosensitive drum; and a transfer roller disposed to transfer said electrostatic latent image from said photosensitive drum onto an individual sheet of printable media, when pushed in contact with said photosensitive drum.

2. The image forming apparatus of claim 1, wherein said cylindrical elastic body is made of one of a urethane and silicone sponge exhibiting said predetermined level of elasticity.

3. The image forming apparatus of claim 1, wherein said cylindrical elastic body is made of rubber.

4. The image forming apparatus of claim 1, wherein said rubber is a conductive material exhibiting a resistance of $10^8$Ω or less.

5. The image forming apparatus of claim 1, wherein said conductive film is made of conductive metallic material.

6. The image forming apparatus of claim 5, wherein said conductive film is an aluminum thin film.

7. The image forming apparatus of claim 1, wherein said image carrier generation layer is coated with pigments from one of $H_2Pc$, CuPc, VOPc, AlCPcCl, InClPcCl, and GaCIPc.

8. The image forming apparatus of claim 1, wherein said image carrier transfer layer is coated with a resin dispersed solution made by dissolving a high molecular weight organic photoconductive substance and a low molecular weight organic photoconductive substance by binder polymer.

9. An electrophotographic processor, comprising:

a photosensitive drum comprised of a cylindrical elastic body exhibiting a predetermined level of elasticity, a conductive film formed on an outer surface of said cylindrical elastic body, an image carrier generation layer of a first photoconductive material formed on the conductive film, and an image carrier transfer layer of a second photoconductive material formed on said image carrier generation layer;

a developing roller disposed to develop a latent image formed on said photosensitive drum into a toner image during an image forming operation;

a charge roller disposed to charge said photosensitive drum for said image forming operation;

a transfer roller disposed to transfer said toner image from said photosensitive drum onto a printable medium; and said photosensitive drum forming a respective nip relative to said charge roller and said transfer roller, when said charge roller and said transfer roller are pushed in contact with said photosensitive drum to enhance the charge and transfer characteristics of said image forming operation.

10. The electrophotographic processor of claim 9, wherein said cylindrical elastic body is made of one of a urethane and silicon sponge exhibiting said predetermined level of elasticity is made of rubber, said image carrier generation layer is coated with pigments from one of $H_2Pc$, CuPc, VOPc, AlCPcCl, InClPcCl, and GaClPc, and said image carrier transfer layer is coated with a resin dispersed solution made by dissolving a high molecular weight organic photoconductive substance and a low molecular weight organic photoconductive substance by binder polymer.

* * * * *